United States Patent [19]

Minkoff et al.

[11] Patent Number: 4,582,323

[45] Date of Patent: Apr. 15, 1986

[54] ELECTRONIC SIMULATED ACTION FOOTBALL GAME

[75] Inventors: Michael D. Minkoff, Torrance; Peter A. Oliphant, Long Beach, both of Calif.

[73] Assignee: Mattel, Inc., Hawthorne, Calif.

[21] Appl. No.: 560,364

[22] Filed: Dec. 12, 1983

Related U.S. Application Data

[63] Continuation of Ser. No. 314,804, Oct. 26, 1981, abandoned.

[51] Int. Cl.[4] ..... A63F 7/06

[52] U.S. Cl. ..... 273/94; 273/85 G

[58] Field of Search ..... 273/1 E, 1 GC, 85 G, 273/88, 94, DIG. 28

[56] References Cited

U.S. PATENT DOCUMENTS

| | | | |
|---|---|---|---|
| 2,680,618 | 6/1954 | Williams | 340/815.24 |
| 4,195,838 | 4/1980 | Santandrea | 273/88 |
| 4,324,402 | 4/1982 | Klose | 273/88 |
| 4,386,776 | 6/1983 | Bromley | 273/85 G |

*Primary Examiner*—Richard C. Pinkham

*Assistant Examiner*—MaryAnn Stoll Lastova

*Attorney, Agent, or Firm*—Ronald M. Goldman; Melvin A. Klein; Daniel F. Sullivan

[57] ABSTRACT

An electronic football game includes an insulating housing supporting a microprocessor control circuit, a plurality of user-operable keys, and a display. The user operable keys facilitate information input to the microprocessor system. The display includes a perspective view of a portion of a football field as it would be seen by a ball-carrier including a pair of merging sideline markers, an end zone, a goal standard, and several yardage markers. A plurality of illuminatable defensive player characters are arranged in three rows facing a stationary ball-carrier positioned in the center foreground of the display. Consistant with the perspective view, the defensive players in the second and third rows are progressively smaller than those of the first row. Under the control of the microprocessor, apparent movement of the stationary ball-carrier is depicted by moving the entire defensive player character illumination pattern in the direction opposite to the intended ball-carrier motion.

11 Claims, 7 Drawing Figures

COP421L
PN2222
33K
51K
100µF
100pF
9V
1·N·914
KICK
PASS

ELECTRONIC SIMULATED ACTION FOOTBALL GAME

This application is a continuation of application Ser. No. 314,804, filed 10/26/81 now abandoned.

BACKGROUND OF THE INVENTION

This invention relates generally to electronic games and more particularly to self contained electronic games capable of playing football and football related games.

The recent developments in semiconductor electronics have lead to the development of microprocessors or microcomputers in which a central processing unit can be fabricated on a single chip and contain sufficient computer logic circuitry that when combined with a read-only memory (ROM) and random access memory (RAM) a miniaturized electronic computer is formed. Generally, the ROM contains the programming of the microcomputer and provides a set of detailed instructions for computer function. The RAM typically provides "scratch-pad" or operational memory for the system in which data is temporarily accumulated during game play for later use. The development of such miniaturized low power computerized systems has spawned a rush of computerized self-contained or hand-held battery-powered games. Such games are available in almost endless variety but all generally share the common components of a battery power source, a miniaturized microcomputer or microprocessor and a display. The display usually comprises either an array of light emitting diodes (LED) or liquid crystal display cells (LCD). In either case, such games generally include a plurality of operator-accessed keys by which communication with the processing unit of the game is achieved and game play is carried forth.

In the type of games to which the present invention most particularly pertains, that is, hand-held games which provide play of American football, the display generally comprises a top-view of a football field, or portions thereof, in which are placed a matrix of LED character elements. Game play generally comprises the manipulation of a ball-carrier in and amongst a plurality of defensive characters to simulating an "overhead" view of a football game. Such games do provide player enjoyment and have enjoyed considerable success in the market place. However, there are many aspects, facets, and sensations of the game of football which are not communicated to the game operator by the foregoing "top-view" football games.

Accordingly, it is a general object of the present invention to provide an improved electronic football game. It is a more particular object of the present invention to provide an improved electronic football game in which heretofore unrealized facets of the game are presented to the player.

SUMMARY OF THE INVENTION

In accordance with the present invention an electronic football game is provided in which a control circuit and a means for providing input signals to the control circuit are combined with a display in a hand-held game. The display includes the depiction of an offensive ball-carrier player and one or more defensive player characters and depicts the game, players and field in the perspective view of an offensive ball-carrier.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings in which like reference numerals identify like objects and in which:

FIGS. 3A through 3E are flow charts of an electronic football game constructed in accordance with the present invention.

DETAILED DESCRIPTION OF THE PREFERRED EMBODIMENT

Figure 1:
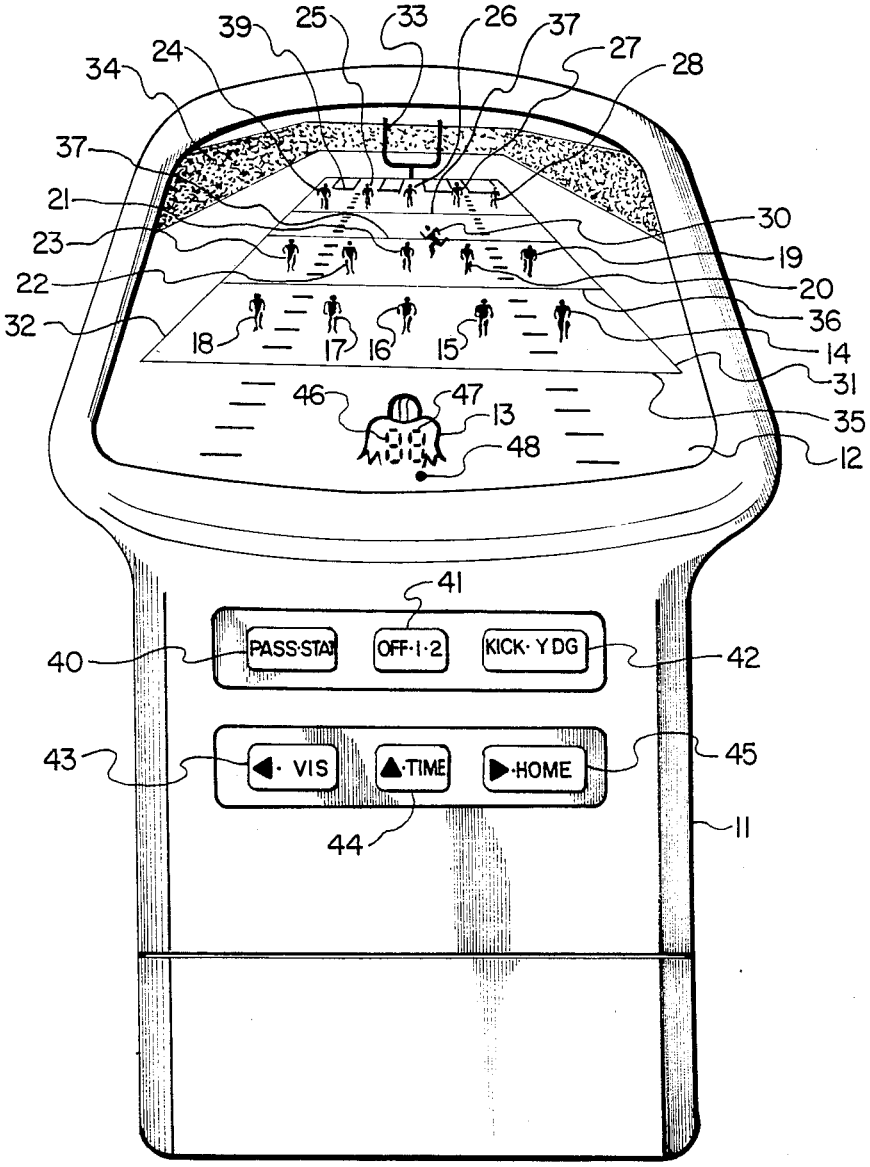
FIG. 1 is a frontal view of an electronic football game constructed in accordance with the present invention.

FIG. 1 shows the exterior of an electronic football game constructed in accordance with the present invention. A molded insulative case 11 supports a football field display 12 and a plurality of user-operable keys 40 through 45 inclusive. Display 12 depicts a ball-carrier perspective view of a portion of a football field bounded by a pair of converging sideline markers 31 and 32 and crossed by plurality of yardage markers 35, 36, 37 and 38 and terminating in a goal line marker 39. A static offensive ball-carrier 13 is positioned at the bottom center of display 12 and includes a pair of seven segment numeric display characters 46 and 47. A first row of defensive players characters 14 through 18 are positioned between yardage markers 35 and 36. Defensive player characters 19 through 23 are positioned in a second row between yardage markers 36 and 37 and since more distant from ball-carrier 13 than those in the first row are smaller and more closely spaced than defensive characters 14 through 18. Defensive player characters 24 through 28 inclusive are positioned in third row between yardage marker 38 and goal line 39 and are for the same reasons still smaller and more closely spaced than defensive player characters 19 through 23. Display 12 further includes a goal standard 33 and a depiction of a portion of a surrounding crowd of spectators 34. A second player offensive player character 30 is positioned overlying yardage marker 37 and is approximately equally spaced from defensive player characters 20, 21, 26 and 27.

Also included in the electronic game set forth in FIG. 1 but not visible in the exterior view are conventional means for supporting a microprocessor computing circuit, a battery power source, an audio transducer and appropriate connections as set forth in the following figures to facilitate electronic football game play. Further, each of said defensive characters 14 through 28 are illuminatable by conventional means. In the present embodiment, a corresponding plurality of computer controlled LEDs are used. Similarly, numeric characters 46 and 47 are positioned overlying the back portion of offensive player 13 and are selectively illuminatable under microprocessor control. This permits appropriate display of numbers in accordance with facets of game play and status as set forth below in detail.

A plurality of user operable keys 40 through 45 inclusive are positioned on the front center facet of case 11. As will be described below in greater detail, each of keys 40 through 45 provides a duplicate function in that under differing game conditions keys 40 through 45 assume different functional relationships. For example, key 40 is labled "PASS/STAT" indicating dual use as either a command to launch a pass or enter the status mode of the game.

Since the game is always played against the computer whether by a single player against the programmed computer defense or between two players taking turns attempting to gain yardage against the computer defense, the initial step prior to game play (once the game is turned on) is to determine the game speed or proficiency level at which the game is to play. There are four levels of skill or game speed designated as rookie 1 and 2 and pro 1 and 2. Game speed is selected by first moving slide switch 41 to the "1" position (i.e. center position). Changes between the pro and rookie levels is accomplished by holding key 43 down and pressing key 40 while in the status mode (described below). Thereafter, selection between stages 1 or 2 of the selected pro or rookie game level are accomplished by moving slide switch 41 to either position 1 or position 2. Once the initial game speed has been selected, game play commences after key 40 has been pressed and the computer sets up the defenders in the top row. Each play is initiated when any run key, that is either key 43, 44, or 45 is pressed. As the play begins, the defensive player characters are "moved" toward offensive player character 13 by random sequenced illumination of selected ones of defensive player characters 14 through 28. If it is desired to carry forth a running play, the operator depresses selected ones of keys 43, 44, and 45 to cause game play to simulate the running of offensive ball-carrier 13. In accordance with an important aspect of the present invention, and consistant with the ball-carrier perspective view of the playing field, pressing left run key 43 causes the existing pattern of illuminated defensive player characters to be shifted a corresponding increment to the right. As a result, apparent motion of ball-carrier 13 to the left is effected. Similarly, pressing right run key 45 causes a corresponding incremental shift of the illuminated defensive player character pattern to the left. Finally, pressing forward run key 44 causes additional motion of the defensive player character illumination pattern toward the bottom of display 12 thus simulating forward motion of ball-carrier 13. As play continues, the random sequence of illuminated defensive player characters 14 through 28 is caused by the program stored within the internal microprocessor to move forward and/or toward offensive player 13. As the pattern of defensive player character motion appearing by sequential illumination of selected ones of player characters 14 through 28 moves downfield toward player 13, randomly occuring openings between the illuminated defensive player characters appear. The object of a running play is to skillfully press run keys 43 through 45, in order to position player 13 in front of a defensive opening or gap and then to move forward therethrough and gain yardage. Under the rules of game play, in the event that player 13 is commanded to move forward or fails to move sideways while defensive player characters 15, 16 and 17 are illuminated, a tackle is determined to have occured and a play is stopped. Thereafter, yardage gain is computed and the current status is updated to reflect the use of one down and the yardage gained.

In addition to running the ball by initiating successive running motions, the operator may select to initiate a passing play. Play is again initiated by pressing either of keys 43 or 45. Thereafter only keys 43 and 45 may be pressed in a play which is to include a pass. After pressing keys 43 and 45 to position ball-carrier 13 at the desired position with respect to the defense, a pass is initiated by pressing pass key 40. Once pass key 40 is pressed, th display "zooms" ahead rapidly. Defensive players speed past and the yardage marker on player 13 rapidly changes. The appearance closely duplicates a camera zoom from the end-zone behind the ball-carrier. Or described another way, the appearance mimicks the "view" of the ball in flight. In any event, the rapid motion gives added realism to game play in accordance with an important aspect of the present invention. The internal microcomputer determines whether or not the pass is completed or intercepted by noting the positions of respective defensive players at the time. The defense intercepts a pass thrown when any one of defensive player characters 16, 21, or 26 is illuminated. If none of defensive player characters 16, 21 or 26 is illuminated, a completed pass results. Offensive pass receiver character 30 is merely a painted symbol for added realism and is not an active player character. After a reception, game play then reverts to place the ball again with offensive ball-carrier 13 at the point of pass completion. Defensive player characters again move toward ball-carrier 13 providing the run after reception, during which the user again operates ball-carrier direction keys 43 through 45 attempting to gain additional yardage.

In both pass and run offensive plays, the potential exists for one of three eventualities, either the defensive tackles the ball-carrier before 10 yards has been gained, the defensive tackles the ball-carrier after 10 yards has been gained but before a touchdown has been reached, or the offensive player character successfully penetrates the entire defensive pattern to reach goal line 39 and score a touchdown. The ball possession aspects of game play are carried forward in accordance with the rules of first and ten etc. established for Americal football.

In addition to plays which carry forward a run or pass, plays corresponding to the punting and field goal aspects of football are available. The start of a kicking play whether punt or field goal is similar to a passing play in that play commences with the pressing of either of run keys 43 or 45. Unlike a passing play however, a kick may be initiated by pressing kick key 42 first. Also, as in a passing play, a kick cannot be undertaken if forward running key 44 has been depressed after the play commences. A kick is initiated during play by pressing kick key 42. Once kick key 42 is pressed, the internal stored program determines whether defensive player character 16 is illuminated. If player character 16 is illuminated a blocked kick is declared and the other team takes possession of the ball at that point. If however, player character 16 is not illuminated at the time a kick is initiated, a kick is launched. A kick distance based upon a random number is selected. If the selected distance crosses the goal line a field goal results. If not, a punt is in effect declared. In either case, the play terminates after the kick and the possession of the ball goes over to the other team. If the kick is a field goal, the other team begins at its 20 yard line. If the kick is a punt or an unsuccessful field goal attempt, play begins at the yardage computed for the kick to have traveled.

In addition to the foregoing game play functions, the internal microcomputer also maintains a status mode in which the progress of the game is maintained and displayed. The status mode is entered by pressing key 40 between plays. The various conditions of the game status are displayed by characters 46 and 47. The yards remaining for a first down are displayed by characters 46 and 47 when key 42 is pressed. The visitors score is displayed by characters 46 and 47 when left run key 43 is pressed. Similarly, the home team score (if two players are playing) is displayed when key 45 is pressed and finally, the time remaining in the quarter is displayed in minutes when run key 44 is pressed. After the desired statistics have been displayed a second pressing of pass key 40 terminates the statistics mode returns the game to play mode. During play, numeric characters 46 and 47 on the back of player 13 continually display the current position of the ball. An internal clock system maintained within the microcomputer keeps track of the time expended during each play. The time increments depicted are not actually of one minute lengths but rather considerably shorter. To give a feeling a kin to established professional rules, four 15 "minute" quarters of game play constitute one complete game.

The present invention electronic football game provides in addition to the various display conditions set forth above a number of sounds which assist the user in determining conditions of play as well as results of play. These sounds are set forth in the following table.

| Sound | Meaning |
|---|---|
| Clock ticking | Game in play |
| Whistle | Defense tackled runner |
| 2 Whistles | Possession changes |
| Low tone | First down |
| High tone | Pass completed |
| Short buzz | Running back hit the sideline |
| Long buzz | End of quarter (ticking stops) |
| 3 Note fanfare | Score field goal! |
| 6 Note fanfare | Score a TD! |
| Long high tone | Now in pro football |
| Long low tone | Now in rookie football |

Figure 2:
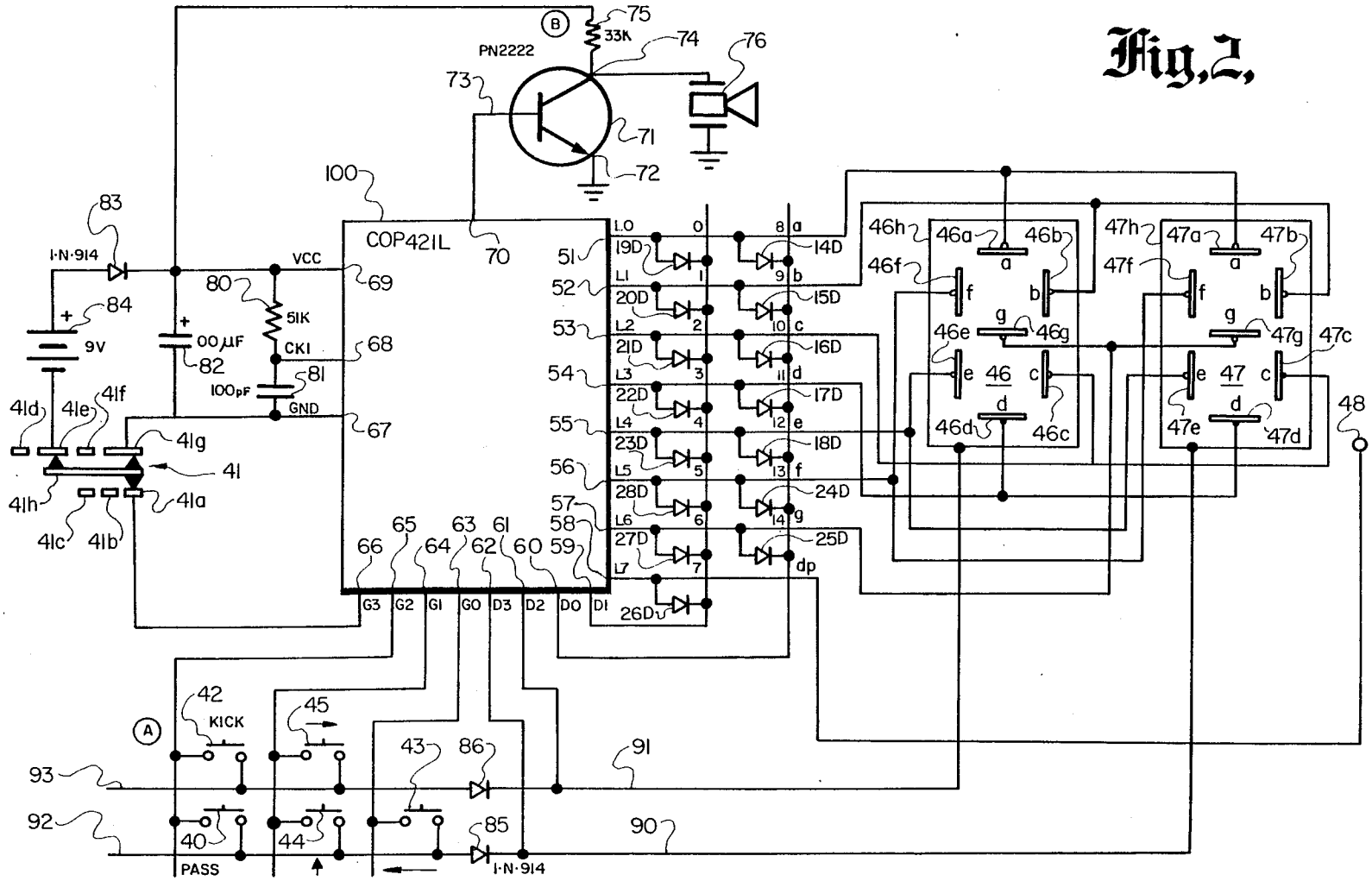
FIG. 2 is a partial block diagram, partial schematic of the circuitry of an electronic football game constructed in accordance with the present invention.
Figure 1A:
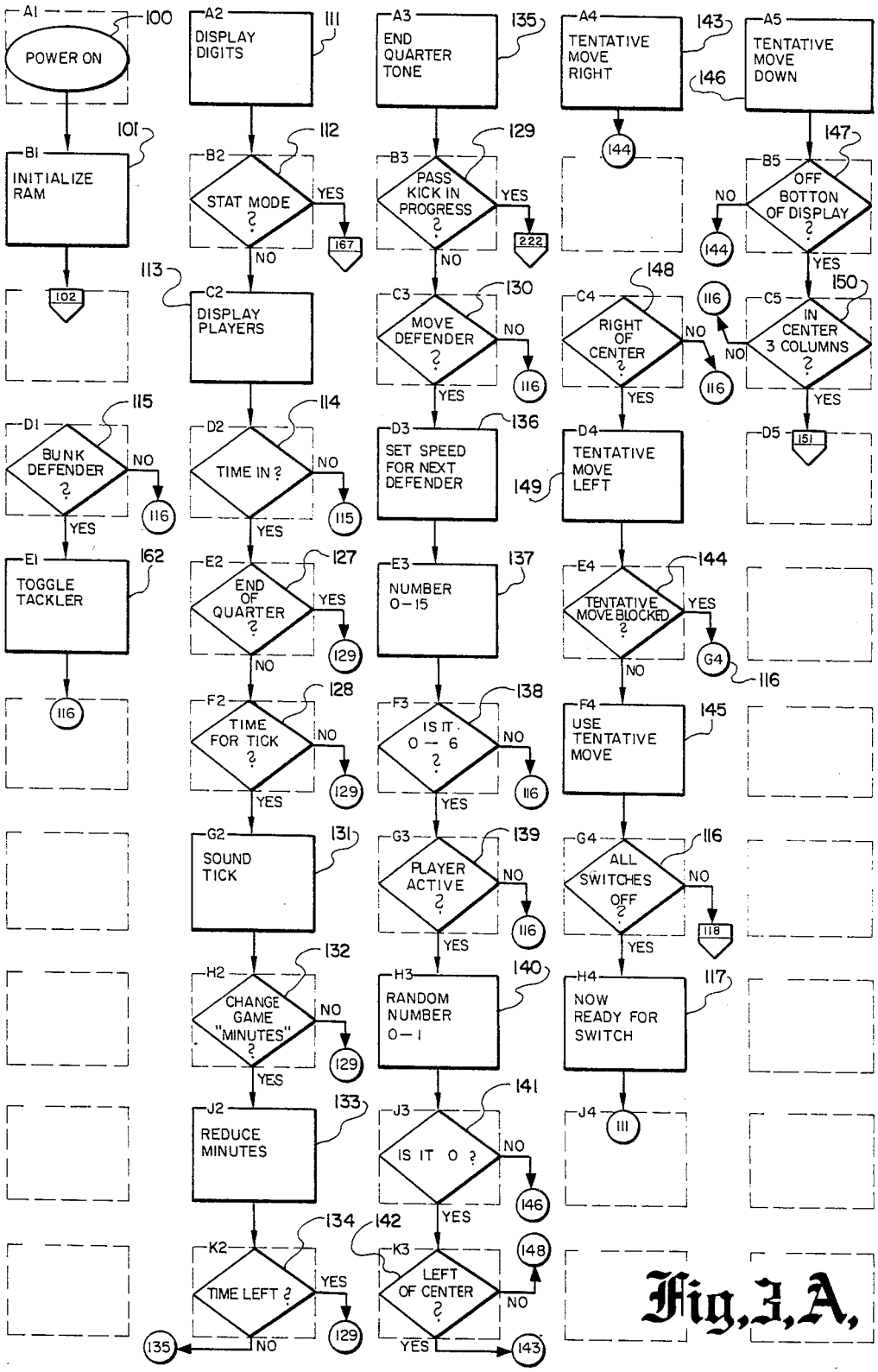

Turning now to FIG. 2 in which a partial schematic, partial blocked diagram of an electronic football game constructed in accordance with the present invention is set forth, a control circuit 100 includes a plurality of data output lines 51 through 58 inclusive, a plurality of data input lines 63 through 66 inclusive, a plurality of information exchange lines 59 through 62 inclusive, a sound output terminal 70, a power supply input terminal 69, a ground terminal 67, and an input terminal 68. A switch 41 (also shown in FIG. 1) comprises a three-position slide switch having a plurality of stationary contacts 41*a* through 41*g* inclusive and a sliding contact bar 41*h*. Contact 41*a* is connected to terminal 66 of control circuit 100, while contacts 41*b*, 41*c* and 41*d* are unconnected. A battery 84 has a negative electrode connected to contact 41*e* of switch 41. Contact 41*f* is unconnected and contact 41*g* is connected to terminal 67 of control circuit 100. A capacitor 81 is connected between terminals 67 and 68 of control circuit 100. A resistor 80 is connected between terminals 68 and 69 of control circuit 100. A diode 83 has cathode electrode connected to terminal 69 of control circuit 100 and an anode electrode connected to the positive electrode of battery 84. A capacitor 82 is connected between terminals 69 and 67 of control circuit 100.

A transistor 71 has an emitter electrode 72 connected to ground, a base electrode 73 connected to terminal 70 of control circuit 100 and a collector electrode 74. A ceramic electro-acoustic transducer 76 is connected between collector electrode 74 and ground. A resistor 75 couples collector electrode 74 to terminal 69 of control circuit 100. A pair of data lines 90 and 91 are connected to terminals 62 and 61 respectively of control circuit 100. A plurality of momentary contacts switches 40, 42, 43, 44 and 45, which correspond to the similarly numbered keys shown in FIG. 1, comprise pairs of connection terminals and momentary normally open bridging contacts. A first common circuit node 92 is connected to one terminal of switches 40, 44 and 43 while a second common circuit node 93 is connected to one contact terminal of switches 42 and 45. A diode 85 has a cathode electrode connected to data line 90 and an anode electrode connected to common circuit node 92. A diode 86 has a cathode electrode connected to data line 91 and an anode electrode connected to data input line 65. The remaining contact of switch 44 is connected to data input line 64 and the remaining contact of switch 43 is connected to data input line 63 while the remaining contacts of switches 42 and 45 are connected to data input lines 65 and 64 respectively.

Data output lines 51 through 58 in combination with data output lines 59 and 60 form a matrix, or multiplexed, display output configuration in which a plurality of light emitting diodes 14*d* through 28*d* are coupled between a selected one of output lines 51 through 58 and output lines 59 and 60. Diodes 19D, 20D, 21D, 22D, 23D, 28D, 27D and 26D all have their respective cathode electrodes connected to data line 59 and their respective anode electrodes connected to data output lines 51 through 58. Similarly, diodes 14D, 15D, 16D, 17D, 18D, 24D and 25D have their respective cathode electrodes connected to data output line 60 and their respective anode electrodes connected to output lines 51 through 57. A first seven-segment alpha/numeric character display 46 has seven character elements 46*a* through 46*f* arranged in a conventional alpha/numeric configuration and a common electrode 46*h*. A second alpha/numeric character display 47 is similarly constructed having seven segments 47*a* through 47*f* and a common electrode 47*h*. A decimal point character 48 is positioned at the extreme right of the combined display of characters 46 and 47. Data output lines 51 through 57 are connected to display element segments 46*a* through 46*g* respectively of character 46 and to segments 47*a* through 47*g* of character 47 respectively. Data output line 58 is connected to decimal point element 48 while common electrode 46*h* is connected to data output line 61 by data line 91 and common electrode 47*h* is connected to data line 62 by data line 90.

As will be readily apparent to those skilled in the art, control circuit 100 may comprise any of several different control circuit configurations including many of the presently available digital electronic circuits. In preferred form, however, control circuit 100 comprises a microprocessor. As mentioned above, such microprocessors combine in miniature microelectronics form a central processing unit typically including a number of interconnected logic gates, and RAM and ROM memories. In combination the miniaturized central processing unit together with the RAM and ROM memories form a digital computer. The ROM is generally formed by a semiconductor masking process and is a permanent storage of digital information which cannot be changed by the central processing unit. In the preferred embodiment, the ROM includes most of the memory functions associated with the rules of American football as well as the basic format under which the game is carried forward. In contrast, the RAM is in effect a scratch-pad for the processing system in which information can be temporarily stored and later retrieved. In normal processing, the information in the RAM is that pertinent to the current actions of the processing unit as well as the accumulated information peculiar to the particular game being played. While there are a great number of different types of microprocessor systems available, many of which are capable of performing the functions of control circuit 100 for the present invention electronic game, a preferred embodiment is found using the COP421L microprocessor manufactured by National Semiconductor and described in detail at page 1-96 of the 1980 MOS Data Book, published by National Semiconductor.

While the operation of the present invention electronic game and the partial schematic partial block diagram thereof set forth in FIG. 2 may best be understood by resort to the flow charts set forth in FIGS. 3A through 3E, several aspects of the circuitry set forth in FIG. 2 can at this point be explained. ON/OFF and Level switch 41 cooperates with battery 84 and diode 83 to provide a source of operating potential at terminal 69 which in turn supplies the internal circuitry (not shown) of control circuit 100. Specifically, with slide contact 41*h* in its left-most position connection is made with contacts 41*d*, 41*f*, and 41*c* all of which have no further connections. Therefore in the left-most position no connection is made between the negative terminal of battery 84 and a source of ground potential. In other words, the game is at this point off. With slide contact 41*h* at its middle position, connection is made between contact 41*e* and contacts 41*b* and 41*g*. While contact 41*b* has no further connection, contact 41*g* is connected to a source of ground potential and therefore a ground path is completed through slide contact 41*h* for battery 84. Thus power is applied to control circuit 100. With slide contact 41*h* in the rightmost position (as presently shown) connection is made between contacts 41*e*, 41*a* and 41*g*. In this position the connection completing ground return for battery 84 via contact 41*e* and contact 41*g* is maintained. However, in addition, contact 41*a* which is connected to input information line 66 of control circuit 100 is also connected to ground. As set forth above, the center and extreme right positions of switch 41 determine the level of skill or speed of the present invention game play. Therefore, the skill level desired for the game is communicated to control circuit 100 by either the grounding or ungrounding line 66.

In addition to the power supply connection to terminal 69, an additional power supply connection is made to collector 74 of transistor 71 via resistor 75. Transistor 71 and associated components forms a conventional grounded emitter audio amplifier. Audio signals appropriate to game play, and supplied by control circuit 100 are amplified by transistor 71 to a power level sufficient to drive electroacoustic transducer 76 and thereby produce augmenting audio tones. LEDS 14D through 28D correspond to the player characters numbered 14 through 28 (shown in FIG. 1). The control of LEDS 14D through 28D is achieved using the above-mentioned matrixing or multiplexing technique in which the LEDS are arranged in an eight by two matrix. Individual LEDS are controlled by simultaneous activation of the row and column data lines associated with it. For example, LED 19D is turned on by simultaneous activation of data lines 51 and 59. Similarly, LED 14D is turned on by simultaneous activation of data lines 51 and 60.

The operation of each segment 46*a* through 46*g* of alpha/numeric display 46 is achieved by simultaneous energizing of selected ones of segments 46*a* through 46*g* and common plane 46*h*. For example, the number "9" is displayed by simultaneous activation of data lines 51, 52, 56, 57, 53, and 54 together wtih data line 91. It should be noted that displays 46 and 47 are identical and each corresponding segment thereof is commonly coupled. As a result, the activation of one of data lines 51 through 58 makes possible the energizing of both character displays. The determination of which numeric character is actually activated is determined by whether or not a simultaneous activation of data lines 91 or 90 occurs. When only one of the numeric characters is to be activated, the appropriate one of the data lines 90 and 91 is activated. In the event that simultaneous displays on both characters are required, the activation of data lines 90 and 91 is caused to alternate at a rate sufficient to give the appearance of simultaneous activation of both characters 46 and 47.

FIGS. 3A through 3E set forth a series of flow charts showing the programming of control circuit 100 for the present invention electronic football game. It should be noted at the outset however that the present invention, as set forth in the appended claims, may be carried forth using any of a number of different microprocessor circuits and programs therefore without departing from the spirit and scope of the present invention. Further, it will be recognized that it is well within the capabilities of those skilled in the art to provide other programs which carry forth the foregoing flow chart in accordance with the present invention. Therefore, the object in setting forth the following flow charts is to describe the present invention electronic football game in its preferred embodiment with the understanding that other embodiments and programs therefore lie within the skill of practitioners of the programming the arts. Because the present invention flow chart is relatively complex and multiple-looped it will be set forth in several figures rather than in a single drawing. Accordingly, the multiple flow chart arrangement in FIGS. 3A through 3E sets forth numbered program steps with subsequent steps indicated by either a direct arrow to the next step (if on the same figure) or to an appropriate number designation (if the next step is on a different figure). By way of example, in FIG. 3A an arrow directly connects step 100 to step 101. However, for step 102 an instruction is given to show that program step 102 is found in FIG. 3E.

As mentioned above and as will be shown in the following discussions, the present invention electronic football game functions in several modes and carries forth a number of different actions during each of these modes. for purposes of overview it should be noted that between plays the operator may elect either to begin the next play directly (play mode) or enter various inquiries of game status (status mode). Similarly, during game play, the user may elect to either pass, run, or kick. Consistent with efficient methods of programing, the program sets forth progressions which frequently "loop" through program portions in multiple recurring arrangements. During the discussions which follow, it will in the interest of brevity be necessary to describe such recurring loops by entry and exit leaving the reader to "follow" the intermediate steps.

Beginning initially with power-on step 100 in which the present invention game is energized, the program moves to step 101 in which the RAM within the control circuit 100 is initialized, that is set to "fresh" game conditions. Thereafter, the program moves to step 102 (in FIG. 3E) in which defensive player characters 24 through 28 are illuminated. Thereafter, the program proceeds to step 103 which indicates that no reset command is required and a time out condition exists. The program next proceeds to step 104 which indicates the selected mode in progress and inhibits the receiving of any further key inputs. Next, the program proceeds to step 105 in which the next play is set up in the center between right and left boundaries. Afterwhich, at step 106 any blinking defensive player from a previous play is extinguished. The program then proceeds to a decision step 107 in which a determination is made as to whether left key 43 is held down. Since the key would not normally be held down during initial power up, the program proceeds to step 108 in FIG. 3B. At step 108 a determination is made as to whether the present ball position is past the fifty yard line. Since no play has as yet been run, the answer is no and the program proceeds to step 109 in which decimal point indicator 48 is activated indicating which side of mid-field the ball is on. Thereafter, the program next proceeds to step 110 where the actual yard line is placed in digit displays 46 and 47. Again, since no play has yet been carried forth, the ball is positioned on the receiving team twenty yard line. The program proceeds to step 111 in FIG. 3A at which the current yardage digits are displayed. Next, the program proceeds to a decision step 112 which determines whether the statistics mode is presently being carried forward. Since this is the initial power-up cycle, the program branches to step 113 in which the current positions of defensive players are displayed. Thereafter the program proceeds to decision step 114 which determines whether time is in. No play having as yet been instituted, the program branches out the negative response to step 115 in FIG. 3A. At step 115 an inquiry is made as to whether it is time to blink a defensive player. No play is in progress and therefore the program branches out the negative response to step 116 in which a determination is made as to whether any of keys 40, 42, 43, 44, or 45 are presently being pressed. No key having yet been pressed, the program proceeds through the affirmative branch to step 117 wherein an indication is made that the system is now ready to accept a key input. Thereafter the program proceeds to step 111 in which the current yardage is displayed. Afterwhich the program proceeds to step 112 in which an inquiry is again initiated as to whether the game is in the statistics mode. Since it is not, the program next proceeds to step 113 in which the current player positions are again displayed. The program next proceeds to a decision step 114 and since time is not in, the program proceeds to step 115 and from there back to step 116 where a decision is made as to whether or not a key has yet been pressed. This looping back from step 116 to step 111 continues until a key has been pressed in which case the program exits the negative response at step 116 and proceeds to step 118 in FIG. 3B.

In step 118, a decision is made as to whether the processor is ready to accept a command. If not, the program again branches back to step 111 and proceeds forward as set forth above. If ready to proceed at step 118, the program moves to step 119 in which an indication is set that the processor is ready to accept a key command. The program thereafter proceeds to a decision step 120 in which a determination is made as to whether the processor is waiting for a reset. If yes, the program branches to step 163 in FIG. 3B, if not the program proceeds to a decision step 121 in which a determination is made as to whether key 44, that is, the forward run key, is pressed. If the run key 44 is not pressed the program brances to step 122 in which a determination is made as to whether left run key 43 has been pressed, if not the program proceeds to a decision step 178.

For purposes of explanation, it will be assumed that a play is commenced by the pressing of left run key 43. Therefore, the program proceeds from step 122 to step 123 in FIG. 3D at which a decision is made as to whether the left side marker has been encountered. In the event that the side line marker is encountered, the program branches to step 182 in FIG. 3D. However, since only one initial left move has been initiated, the response is no and the program proceeds to a step 124 in which an indication of ball-carrier position one step closer to left side line is maintained. The program next proceeds to a step 125 in which all defenders are moved one column to the right. It should be noted at this point that this is in accordance with an important aspect of the present invention in which the stationary ball-carrier is given apparent motion by the corresponding opposite direction movement of the entire defensive player character field.

Figure 3B:
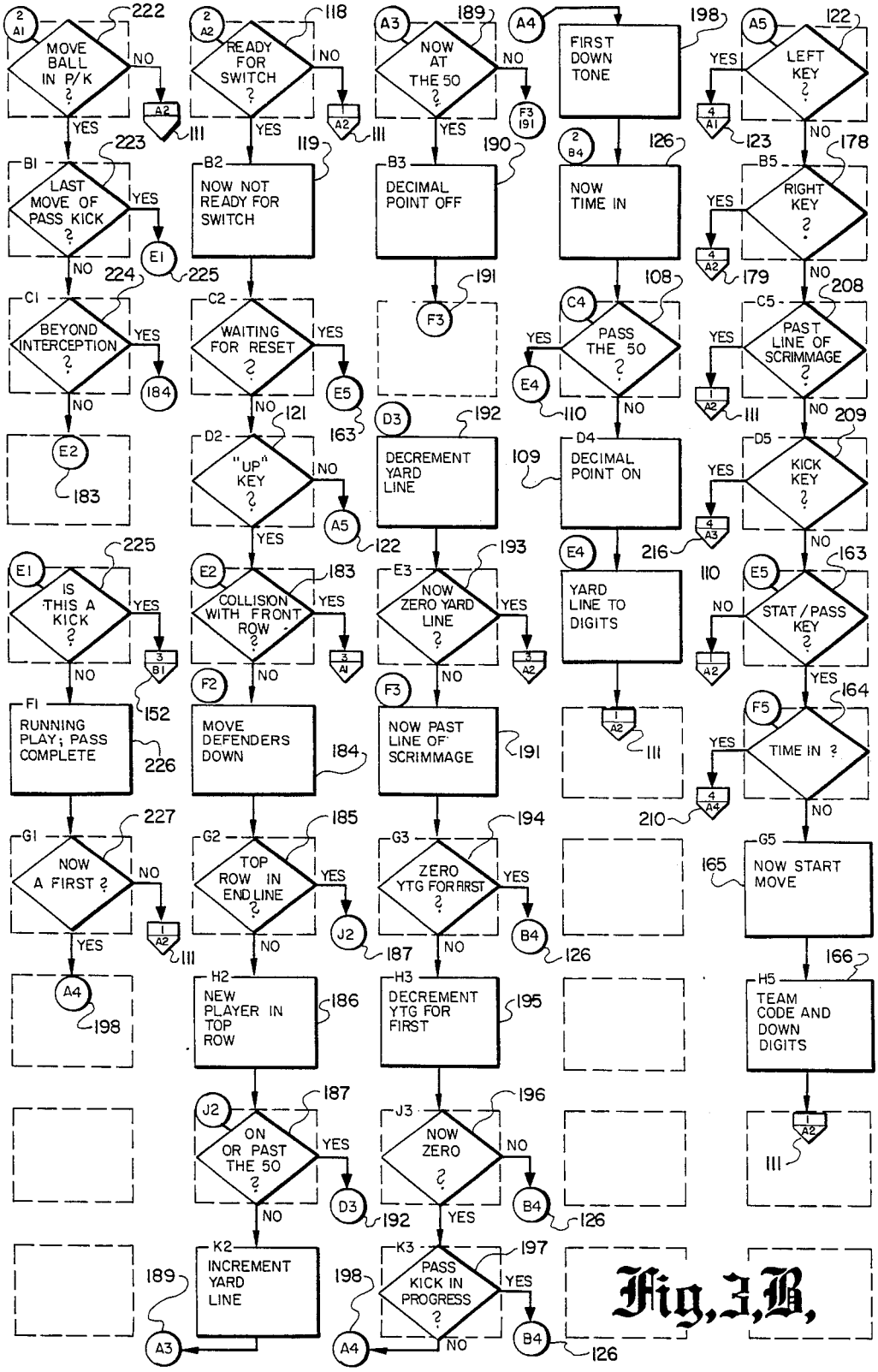

Thereafter, the program proceeds to step 126 in FIG. 3B in which information is sent to the processor indicating time is now in afterwhich the program proceeds to a step 108 in which a determination is again made as to which side of the fifty yard line the ball is on. In accordance with the foregoing explanations, the program again progresses from step 108 through steps 111, 112, 113 to again reach step 114. This time however, a play is in progress and therefore time is in and the program branches to step 127 in which a determination is made as to whether the end of a quarter has been reached. Since at this point a quarter has not ended, the program proceeds to a decision step 128 in which it is determined whether it is time to move the play clock one increment or "tick". Assuming sufficient game time has not yet been used, the response is no and the program proceeds to step 129 in which a determination is made as to whether a kick or pass is in progress. Since this is a run play, the program responds negatively and the program moves to a decision step 130 in which it is determined whether the microprocessor should at this time (according to its stored program) move a defensive player. If it is not yet time to move a defensive player, the program continues to loop back to step 116 to deermine whether a key has been pressed. If no keys have been pressed, the program continues to loop back to step 111 and to proceed through steps 111, 112, 113, 114 where it is determined that time is still in and the program again proceeds to step 127 in which it is determined that the end of a quarter has not yet been reached moving the program forward to step 128. As previously stated, step 128 determines whether it is time to move the game timer one tick. At this point, such time shall be assumed to have passed and accordingly the program branches to step 131 and a tick sound is caused to be produced. Thereafter the program moves to step 132 in which a decision is made as to whether it is time to decrement the "minutes" clock of the system. If not, the program returns to step 129, if it is time to decrement the game clock by one minute, the program proceeds to step 133 in which the stored game time remaining is reduced by one minute.

Next, the program proceeds to a decisions step 134 in which a determination is made as to whether any playing time remains in the quarter. If playing time remains, the program returns to step 129, if time has expired for the quarter, the program returns to step 135. In the later case, a tone indicating the end of a quarter is generated in step 135 afterwhich the program again returns to step 129. From step 129, the program proceeds to a decision step 130 in which it is again determined whether it is time to move a defender. Assuming sufficient time has elapsed for an affirmative response, the program moves to step 136 where the speed of game is determined. Thereafter, the program moves to step 137. Steps 137 through step 150 generate a sequence of random numbers which are used to provide random defensive pattern motion toward the stationary ball-carrier. Accordingly, at step 137 a random number between zero and fifteen is selected afterwhich the program proceeds to a decision step 138 and determines whether the number generated is between zero and six. If it is not, the program returns to step 116. If it is between zero and six, the program moves to step 139 in which it is determined whether the defensive player selected to be moved is an active player, that is illuminated. If the player is not active the program again returns to step 116. If the selected player is active, the program proceeds to a step 140 in which a random selection between numbers zero and one occurs. Thereafter, the program proceeds to a decision step 141 and if the number selected in step 140 is a zero, the program proceeds to a decision step 142. If it is not the program branches to step 146.

In step 142 a determination is made as to whether the selected player is to the left of center. If the selected player is not to the left of center, the program branches to step 148. If it is to the left of center, the program moves to a step 143 in which the processor tentatively moves the selected player one step toward the right. If the program had at step 142 moved to step 148, a determination therein as to whether the selected defensive player is to the right of center would occur, and if not so the program would return to step 116. If the selected player were to the right of center, the program would proceed to step 149 which tentatively moves the selected defensive player one step to the left. In either event, from step 149 or from step 143 the program moves to step 144. Exploring the remaining alternative in step 141 shows that if in step 141 a one number is determined the program branches to step 146 in which the selected defensive player is tentatively moved one step vertically toward the ball-carrier. Thereafter, the program proceeds to step 147 in which a determination is made as to whether the move tentatively made in step 146 will result in moving the selected player off the display, if not the program branches directly to step 144. If yes, the program proceeds to step 150 in which it is determined whether the tentative player is in one of the three center columns. It should be noted at this point that the movement of a center defender that is one of the three center front row defenders, (numbers 15, 16, and 17 in FIG. 1) to the next position toward the ball-carrier results in the declaration of a tackle. Therefore, if at step 150 an affirmative occurs, the program moves to step 151 in FIG. 3C and the tackling routine is entered. If not one of the three center front defensive players, the program branches back to step 116 and proceeds forward again.

For purposes of explanation, it is assumed that no tackle occurred. Returning therefore to step 144, the program determines whether the tentative move is blocked by another player and if so branches the program back to step 116. If not blocked, the program enters step 145 and actually institutes the move. Thereafter, the program returns to step 116 and continues as set forth above. From step 116, the program once again progresses in a loop via steps 116 and 117 back to step 111 and back to step 116 until another key has been pressed, whereupon the program again proceeds in similar fashion to that set forth above via step 118 to step 121. At step 121, a determination is again made as to whether forward run key 44 has been pressed.

As a second example it is assumed that at this time the user has chosen to operate right run key 45. Accordingly, the program branches from step 121 to step 122 and, since the left run key is not pressed, from step 122 to step 178. Because right run key 45 is pressed, the program proceeds to step 179 in FIG. 3D at which a determination is made as to whether the offensive player has reached the right sideline. If so, the program branches to step 182. If not, the program proceeds to step 180 in which the ball-carrier position indication is incremented one step closer to the right sideline. Thereafter, the program proceeds to step 181 in which all defenders are moved one column to the left. As set forth above, this movement of the entire defensive field is in accordance with an important aspect of the present invention in which apparent ball-carrier motion is provided by opposite direction motion of the entire defensive field.

Once the defense is shifted, the program returns to step 126 and, since time is still in, the program proceeds through steps 126, and step 108 through 111. From step 111 the program again proceeds to step 127. Thereafter the program proceeds through steps 127 or 128 to step 129 in which a determination is made as to whether as pass in progress. Since no pass is in progress, the program again moves through the appropriate sequence of steps including some or all of steps 130, 136, 137, 138, 139, 140, 141, and 142 to ultimately return to step 116. As will be seen, the foregoing steps form multiple branches which involve movement of defensive players in the random arrangement. At step 116 a determination is once again made as to whether all keys are off. If no keys are pressed, the program again begins looping from step 116 through step 117 to step 111 and ultimately to step 116. When a key is pressed, which in the present example is forward key 44, the program branches from step 116 via step 118 to return to step 121 and in this example since the forward run key 44 has been pressed, the program proceeds to step 183. A determination is made in step 183 as to whether a collision between the ball-carrier and front-row center defender 16 is imminent. If it is, the program enters the tackling routine and thereafter proceeds to step 151 in FIG. 3C causing the "tackling" defensive player to blink. Next the program moves to step 152 in which a whistle sound indicative of a tackle is generated. Thereafter, the program moves to step 153 in which a determination is made as to whether a quarter has ended. If it has, the program branches to step 228. If it has not, the program proceeds to step 154 in which a determination is made whether the previous play was a pass or a kick. If either a pass or kick, the program branches to step 237 but if not, as was the case here, the program continues to step 155 in which a determination is made as to whether a first down was achieved.

If a first down was achieved, the program moves to a step 206. If a first down did not occur, the program moves to a step 156 in which a determination is made as to whether the previous down was fourth down. If fourth down the program branches to step 237 in which a second whistle sound is generated and thereafter proceeds to step 238. At step 238 a change of sides is implemented. Since however in our example, it is not fourth down, the program proceeds to step 157 from step 156 in which the down number is incremented by one afterwhich the program proceeds to step 158. Returning to step 183 and discussing program progression from step 183 if no collision is imminent between the front row center defensive player and the ball-carrier, the program moves to step 184 in which all defenders are moved one row closer to the ball-carrier. As set forth above in connection with ball-carrier moves to the right and to the left, it should be noted that in accordance with an important aspect of the present invention the forward motion of the ball-carrier is accomplished by opposite direction motion of the entire defensive field. Once the defense has been moved, the program proceeds to step 185 in which a determination is made as to whether the top row of the defense is part of the end zone. If it is, the program branches to step 187 but if not the program proceeds to step 186 in which a player is randomly placed in the top defensive row. Thereafter, the program proceeds to step 187 in which a determination of whether the fifty yard line has been crossed is made and if so the program branches to step 192 but if not the program proceeds to step 188 in which the yardage is incremented by one yard. Next, the program proceeds to step 189 in which another determination of whether the ball is at the fifty yard line or not is made and if not the program proceeds to 191 but if so the program proceeds to step 190 in which decimal point 48 is turned off and from there to step 191. Had the program moved from step 187 to step 192 because the fifty yard line had been passed, the program at step 192 would decrement the yardage by one and proceed to step 193 wherein a determination is made as to whether a score has occurred. If a score has occurred, the program branches to step 199, if not, the program continues to step 191 in which an indication is made that the ball-carrier has crossed the line of scrimmage. Thereafter, the program proceeds to step 194 in which a determination is made as to whether there are zero yards remaining for a first down and if so the program branches to step 126 but if not the program proceeds to step 195 in which the number of yards remaining for a first down is reduced by one. Next, the program proceeds to step 196 and another determination is made after decrementing as to whether there are zero yards to go for a first down. If there are not the program branches to step 126. If there are the program continues to step 197 in which a determination is made as to whether a pass or kick is in progress. If a pass or kick is in progress, the program again branches to step 126 but if not the program continues to step 198 in which a first down tone is generated. Thereafter the program proceeds to step 126 in which an indication is made that time is in. The program thereafter moves from step 126 to step 108 and from step 108 in accordance with the operation set forth above the program again returns to step 111. Until a key is pressed the program cycles between step 111 through steps 115 and 116 whereupon the program once again proceeds through step 118 down to step 121 where the initiation of inquiry is commenced as to which key the operator has pressed.

The foregoing cycle will repeat as the operator continues to press keys 43, 44 and 45 to avoid defenders. At some point, a tackle, or touchdown (later described) will occur and a new play will be set up and the program will again reach step 121 because the operator has pressed a key. For illustration it is assumed that pass key 40 is now pressed. In accordance with the previously explained routine, the program upon reaching step 121 determines whether the forward run key 44 is pressed, if not the program progresses to step 122 in which a determination is made as to whether right run key 45 has been pressed, and if not the program proceeds to step 208 in which a determination is made as to whether the ball-carrier has crossed the line of scrimmage. If the line of scrimmage has been crossed, the program branches to step 111. If however the ball-carrier has not crossed the line of scrimmage, the program proceeds from step 208 to step 209 in which a determination is made as to whether the kick key 42 has been pressed. Since our present example is a pass, the program proceeds to step 163 in which a determination is made as to whether pass key 40 has been pressed.

At this point it should be noted that the foregoing sequence of inquiries in steps 121, 122, and 178 could have been answered in the affirmative consistent with an eventual determination to launch a pass in step 163. Had this been the case for example, if there were successive pressings of keys 43 and/or 45 in steps 122 and 178 to permit the ball-carrier passer to avoid defenders, the program would repeatedly branch back through to step 111 and ultimately return to step 121. The inquiry continues eventually arriving at step 163 whereupon the pressing of pass key 40 moves the program to step 164 in which a determination as to whether time is in occurs. If time is in, the program branches to step 210 in FIG. 3D. In step 210 an indication of a pass play in progress is produced whereupon the program proceeds to step 211 in which a random number between zero and fifteen is selected. The program next proceeds to step 212 in which it is determined whether the random number selected in step 211 is between zero and three, and if it is the program proceeds to step 213 in which the value from four to seven is assigned to the pass. If not between zero and three, the program skips directly to step 214. In either event, at step 214 a determination of pass length based upon the random numbers generated in steps 211, 212, 213 is made. Thereafter, the program proceeds to step 215 in which the number "3" is stored to indicate to the microprocessor that the pass must successfully pass through three rows of defenders in the center of the display without encountering an illuminated defensive player character in order to be completed. The program then returns to step 111 in FIG. 3A and proceeds from step 111 through steps 114, and intermediate steps to step 129. In step 129, a determination is made as to whether a pass or kick is in progress. In this case since a pass is in progress the program branches to step 222 in FIG. 3B. In step 222 a determination is made as to whether it is time to advance the yard line and move the defensive pattern if so, the program moves to step 223 in which a determination is made as to whether the pass yardage has been reached. If it has, the programmed progresses to step 225 but if not as in the present case, the program proceeds to step 224 in which a determination is made as to whether the number "3" stored in step 215 has been decremented to zero. If it has, the program proceeds to step 184 but if not the program proceeds to step 183 in which a determination is made as to whether a front row defensive character is present for an impending interception. If a defender is present, an interception is declared at steps 151 et seq. If not the pass has "gone over" the first of the three required defenders and the program proceeds to step 184 in which all defenders are moved one row forward. Thereafter, the program moves to step 185 in which it is determined whether the top row is that of the end zone and if not the program proceeds to step 186 to randomly place a player in a top row. Since the end zone has not been reached the program proceeds through steps 187, 188 and 189 to step 191 depending on whether the fifty yard line has been traversed, to step 191 and thereafter from step 191 through steps 194, 195, 196 to step 197 in which a determination is made as to whether a kick or pass is in progress. Since a pass is in progress, the program branches to step 126 and from there to step 108, 109, 110, and returns to step 111. From step 111 the program proceeds through steps 112, 113, 114, to steps 127, 128, 131, 132, 133, and 134. From there the program continues to step 129 in which the determination that a pass is in progress causes the program to branch back to step 222. At steps 222 through 224, the determination is made that the number three has been decremented to "2" not "0" and it is decremented by one and the foregoing loop is again entered whereby the program if no defender is encountered in step 183 again returns to step 222. This looping continues until the third time when the decrementing has reduced the number "0" without encountering a defensive player character in step 183. Thereafter, the program continues to loop until the previously computed pass yardage is reached whereupon a determination occurs in step 223 that this is the last move of a pass and the program branches to step 225. At step 225 a determination is made as to whether the foregoing play is a kick. Since this is not the case, the program proceeds to step 226 in which a completed pass tone is produced. Thereafter, the program proceeds to step 227 in which a determination is made of first down attainment. If no first down is attained, the program returns to step 111 but if a first down has been achieved the program proceeds to step 198. A first down tone is initiated at step 198. The program then proceeds back to step 111 in the manner set forth above to complete the pass play and return to a run format. It should be noted that this "return to run play" is intended to simulate the attempt by a pass receiver to fruther advance the ball after a completion thus adding additional authenticity to the present invention game play.

As previously mentioned, the flow charts of FIGS. 3A through 3E include several paths of information processing which may be described as recurring or main loops in the sense that the program repeatedly branches in and out of certain paths. Similarly, several steps within the program define portions to which the program repeatedly returns during the course of game play. As is already apparent, one such point is step 121 in FIG. 3B. The program often returns to step 121 at which point the program flows through alternatives of step 121, 122, 178, 209, and 163 by various combinations of paths to, in essence, carry forth a determination of which key is being pressed.

The discussions set forth above have provided individual explanations of the processes which ensue when the left run key 43, forward run key 44, and right run key 45 as well as pass key 40 are pressed. It remains for a complete explanation of game play to provide an explanation of the kick function of the game. At the outset, it is believed that the kick routine will be best understood if some prefactory remarks are set forth. Accordingly, it should be noted that the game provides two types of kicks. One corresponds to an attempted punt and the other corresponds to attempted field goal. In both cases, the launching of the kick is determined solely by whether defensive player 16 (see FIG. 1) is illuminated at the time the kick is instituted. If player 16 is illuminated the kick (whether punt or field goal) is blocked. If player 16 is not illuminated, the total yardage, if a punt, or the likelihood of scoring, if a field goal, is determinated by a weighted random number generator within the system.

With this understanding the kick routine of the program may not be considered. Commencing at step 121 assuming kick key 42 is pressed and assuming it has been determined in step 116 that one of the keys is pressed, the program moves successively through negative responses for steps 121, 122, 178, and 208 to step 209. At step 209, the pressing of kick key 42 causes the program to move to step 216 in FIG. 3D. It should be noted parenthetically here that the inquiry in step 208 is consistent with the rules of football where a kick or pass cannot be instituted once the line of scrimmage has been crossed. In step 216 an indication is made to the microprocessor system that a kick is in progress. The program then proceeds to step 217 in which a random number between zero and sixty-three is generated. Thereafter, the program proceeds to step 218 in which a determination is made as to whether the random number generated is between zero and seven. If it is not, the program proceeds directly to step 220. If it is between zero and seven, the program proceeds to an intermediate step 219 in which the number generated is increased by eight to lie within eight and fifteen respectively. In either event, the program next moves to step 220 in which the kick length is determined. Thereafter the program proceeds to step 221 in which the potential blocking position that is, the defensive player 16 directly in front of the ball-carrier is designated. The program then proceeds to step 126 in FIG. 3B. As previously described for a run situation the program proceeds from step 126 through 108 depending on whether the ball is positioned before or after the fifty yard line. The program proceeds via a combination of steps 108 through 110 to return to step 111 in FIG. 3A. Again, the processing from step 111 which is similar to that previously explained is carried forth through steps 111, 112, 113, and 114, 115, 116. At step 116 a determination is made as to whether all keys are off. If the operator's finger has not yet been removed from kick key 42 at this point the program loops back to step 111 and again returns via the above-described path to step 116. This loop-ing continues until a determination at step 116 is made that all keys are off. Thereafter, the program proceeds to step 117 in which an indication is made within the system that the processor is ready to accept another key pressing. Next, the program returns to step 111 and proceeds from step 111 to step 112. Since the game is not in statistics mode, the program proceeds from step 112 to step 113, and from there to step 114. Similarly, since time is in the program proceeds to step 127. Since the quarter has not ended the program moves to step 128. Steps 128, 131, 132, 133, and 134, 135 include a time keeping subroutine and the program eventually by different paths for different conditions of elapsed time again reached step 129 in which a determination is made as to whether a pass or kick is in progress the program branches to step 222 in FIG. 3B. In step 222 it is determined whether the ball is to be moved forward. If it is not yet time, the program loops back to step 111 and through the above step sequence to eventually return to step 222. At the appropriate time, the program moves the ball forward from step 222 to step 223. At step 223 a determination is made as to whether the yardage for the kick has been reached. If it has, the program moves to step 225 if not it moves to step 224. Because this is a kick rather than pass situation only one loop through step 224 is required to move from step 224 to step 184. At step 184 all defenders are moved one row forward. The program then proceeds via steps 185 through 191, and from step 191 to step 126 by the appropriate steps and back to step 111. From step 111 the program returns to step 223 completing the loop. This looping continues until one of two conditions is satisfied to allow the program to exit the loop. Either the kick travels its assigned distance in which event the program exits the loop at steps 223 and from there moves to step 225 or the kick reaches the goal line and the program exits the loop at step 193 and moves to step 199. If the former occurs first, the kick is a punt and ball possession changes. If the latter occurs first, the kick is a field goal and a score results.

Figure 3C:
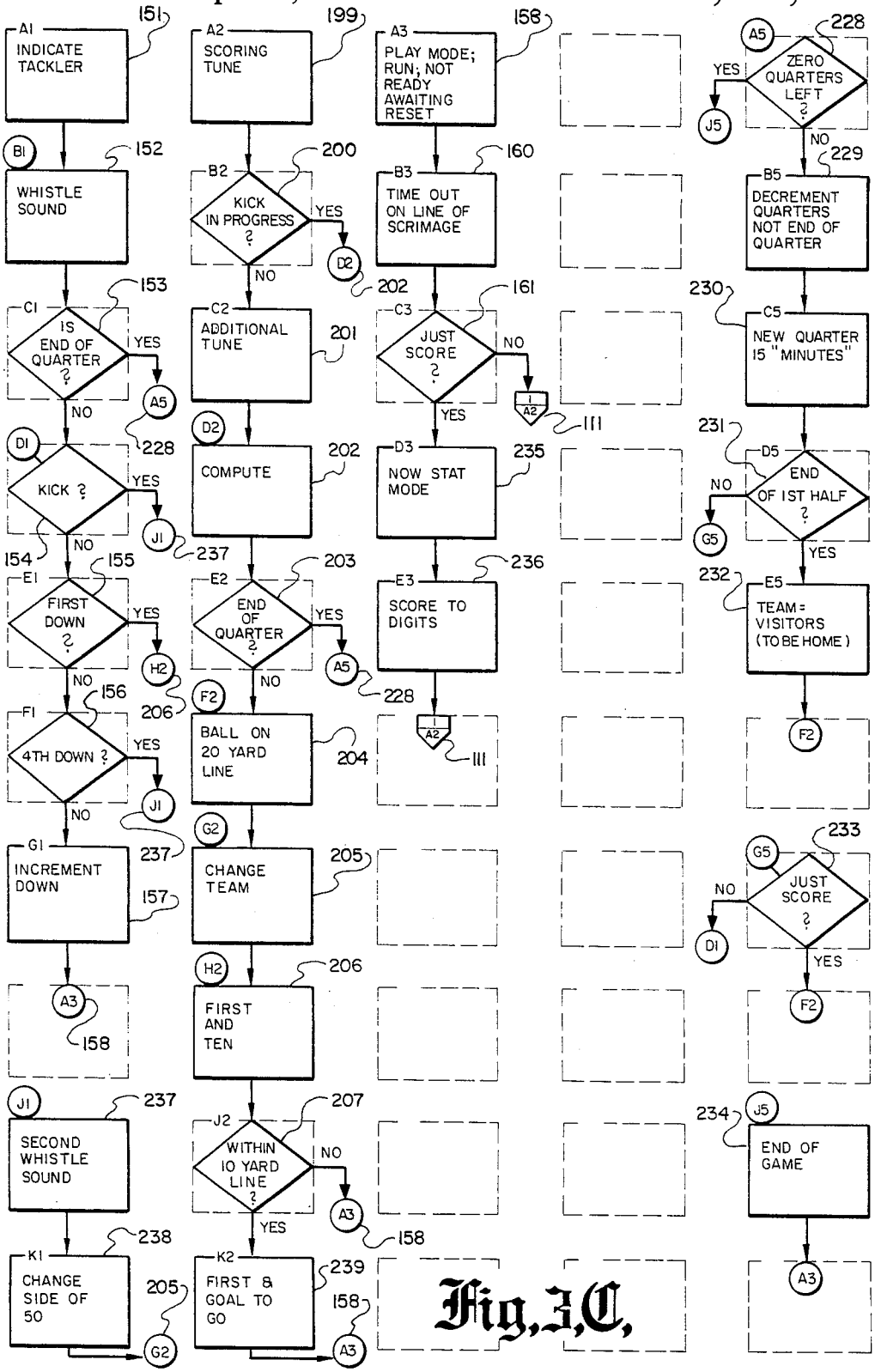
Figure 3D:
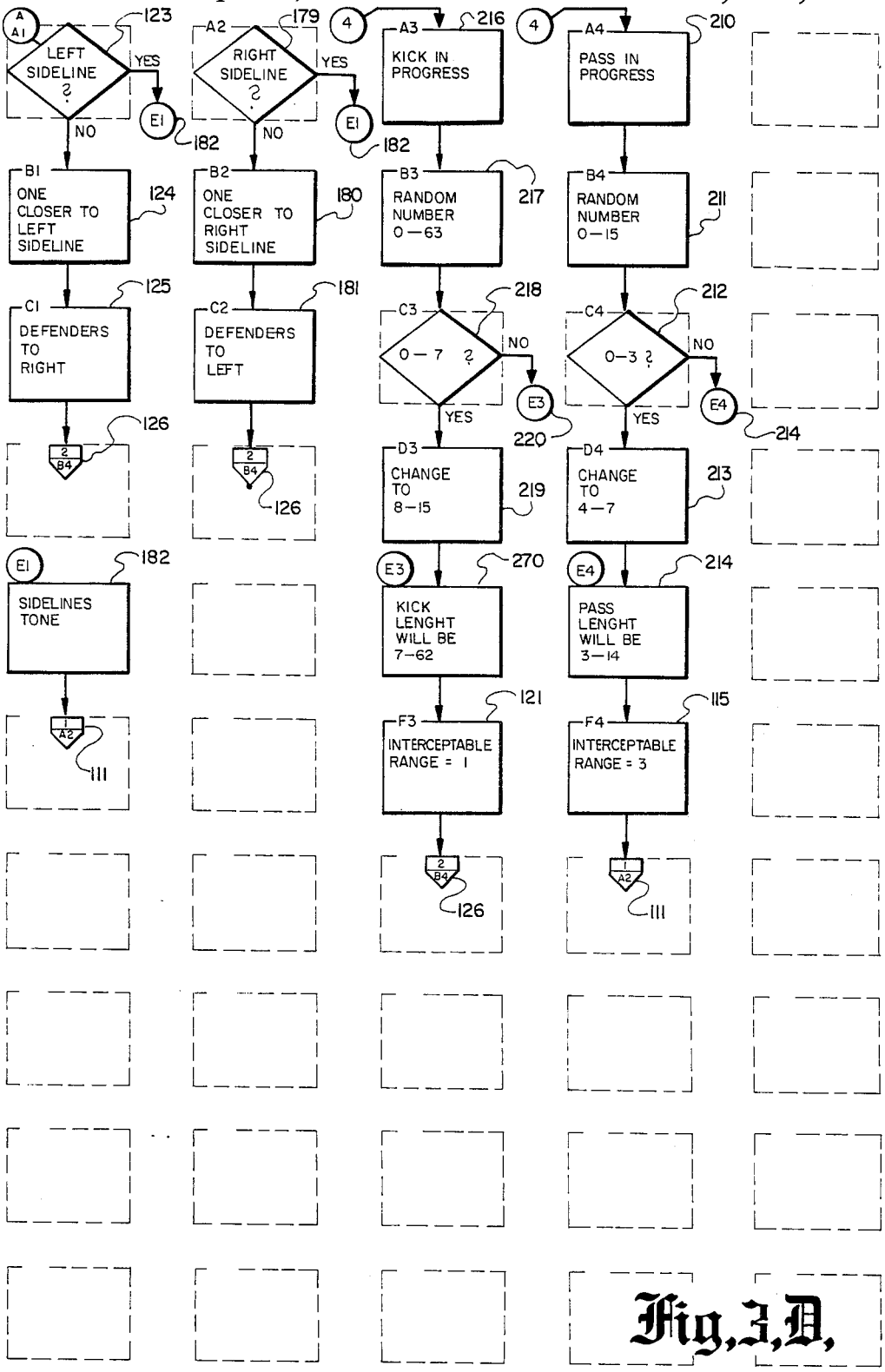
Figure 3E:
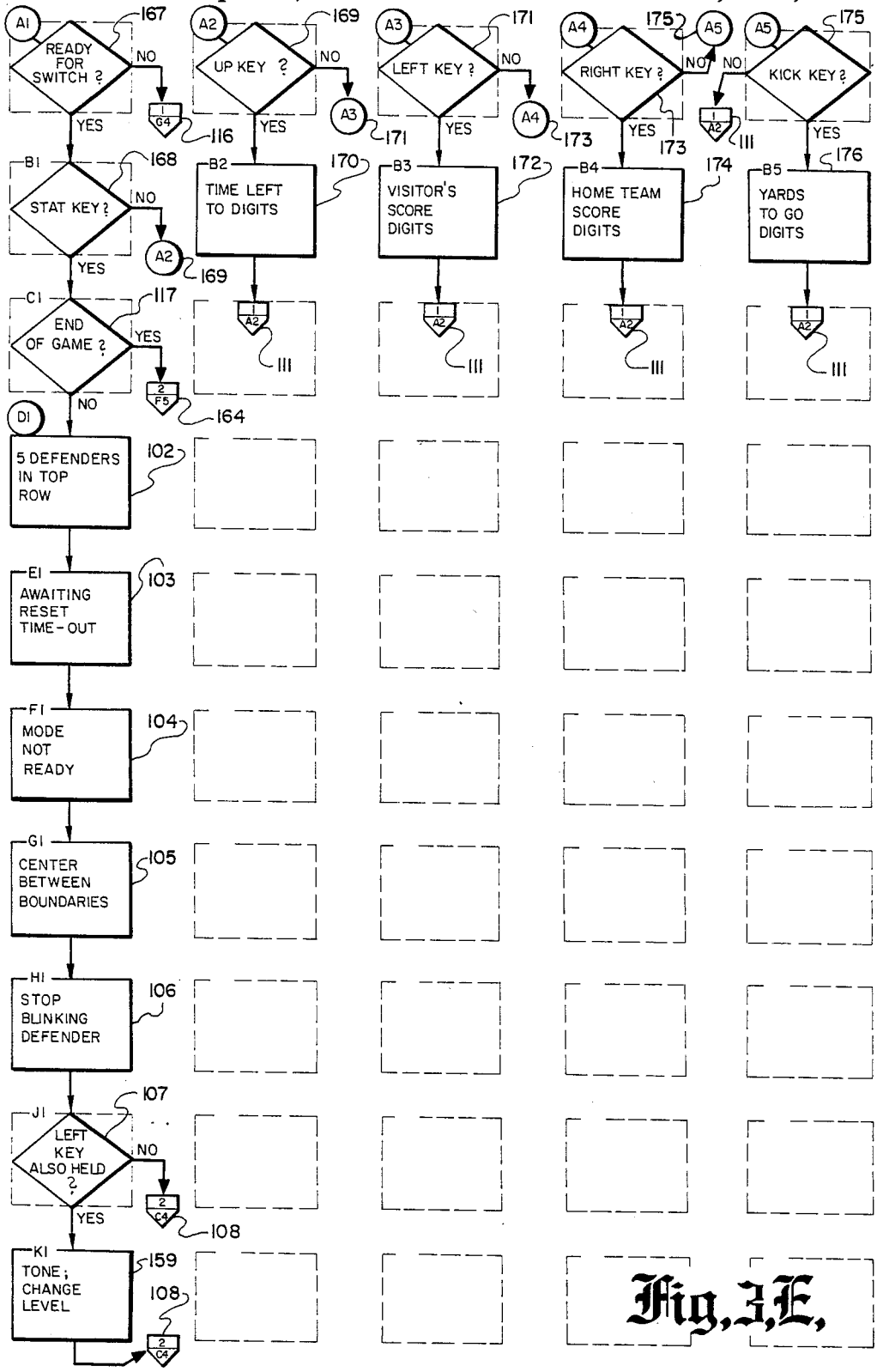

Considering first the condition which results in a punt, the program proceeds from step 223 to step 225 and since the play was a kick the program moves to step 152 in FIG. 3C. At step 152 a whistle sound is generated afterwhich the program moves to step 153 in which an inquiry is made as to whether the end of a quarter has been reached. Since this is not the case, the program continues to step 154 in which a determination is made as to whether the play was a pass or a kick. Again, this having been a kick play, the program branches to step 237 and a second whistle tone is generated. Thereafter, the program proceeds to step 238 in which appropriate marking of yard line with regard to midfield is carried forward. The program next proceeds to step 205 in which a change of team possession is carried forward. Thereafter, the program proceeds to step 206 which sets up the first and ten for the team presently possessing the ball. The program then proceeds to a decision step 207 in which it is determined whether the ball now rests between the ten yard line and the end zone. If not, the program moves directly to step 158 but if the ball is so placed, the program moves to an intermediate step 239 in which the yardage needed for a first down is set equal to the ball position rather than ten yards. Thereafter the program proceeds through steps 158, 160 and 161 in which a new play is set up and indication is made that reset is needed. Thereafter the program moves to step 111 in FIG. 3A.

Considering now the program in which a field goal results, and returning to step 193 in FIG. 3B, a determination as to whether the kick has passed the goal line is made.

If the ball position has been decremented (by successive loopings) to zero the program branches at step 193 and thereby exits the loop and proceeds to step 199 in FIG. 3C. In step 199 a scoring tune is generated and the field goal score is set up in the processor. Thereafter, the program proceeds to step 200 and since a kick was in progress the program continues to step 202. At step 202, the score appropriate for a field goal is added to the scoring team's total. Steps 203, 204, 205, 206, 207, 158, 160 and 161 then follow to essentially set up the next play from the 20 yard line for the other team (i.e. the team scored upon). Thereafter, the program returns to step 111 in FIG. 3A.

In addition to the foregoing descriptions of play mode for run, pass and kick the present invention electronic game includes a status mode in which keys 40, 42, 43, 44, and 45 perform secondary functions permitting the players to interrogate the microprocessor as to the current status of the game. Essentially, the opportunity to enter the status mode is presented between plays and results from pressing pass/stat key 40 when a time out exists. Turning now to the flow chart and again picking up the discussions at step 116 of FIG. 3A, it is assumed that the preceding play has terminated and key 40 has been pressed. In accordance with the foregoing discussions, the program moves, once a key is pressed from step 116 to step 118 and from step 118 to step 121 where it is determined that it is not run key 44 which is pressed. The program then branches to step 122 and since it is not the left run key 43 which is pressed, the program proceeds to step 178. Again, since it is not right run key 45 which is pressed, the program proceeds to step 208. The line of scrimmage has of course not yet been traversed and the program proceeds to step 209. Since the pressed key is not kick key 42 the program proceeds to step 163 in which is is determined that the pass/stat key 40 has been pressed. The program then proceeds to step 164 in which a determination is made as to whether pass/stat key 40 is pressed during a time-in or time-out situation. As stated, it is assumed that key 40 is pressed during a time-out. The program proceeds from step 164 to step 165 in which an indication is made that the status mode has been entered whereupon the program then proceeds to step 166. At step 166 the ball possession code (H-home, V-visitors) and the down, is prepared for display. Thereafter the program returns to step 111 in FIG. 3A. In step 111 the current digits determined in the preceding step are displayed and the program proceeds to step 112. The program proceeds from step 112 to step 167 in FIG. 3E in which a determination is made as to whether the system is ready to accept a new key, if not, the program loops back to step 116 and by the foregoing path will continue to return to step 167 until all keys are clear, whereupon the program proceeds to step 168. In step 168 a determination is made as to whether the program is to return to the play mode. As can be seen in step 168 if key 40 is again pressed, the program will return to game play via steps 177 and 102. If however a continued interrogation of status mode is being carried forward (that is, another status key is pressed) the program proceeds from step 168 to step 169 in which a determination is made as to whether key 44 is pressed. If key 44 is pressed the program moves to step 170 in which the time remaining is transferred to and displayed in the current digits. Thereafter, the program returns to step 111 and by the foregoing described loop returns to step 168 permitting the program to proceed for further status interrogation. If at 169 it is determined that the key 44 is not pressed, the program moves to step 171 in which it is determined whether the left run key 43 is pressed, if so the program moves to step 172 in which case the visitor's score is displayed in the current digits. Thereafter, the program returns to step 111 and if the status mode is maintained moves by the foregoing path return to step 168 and continue to step 171. If at step 171 it is determined that key 43 is not pressed, the program moves to step 173 in which a determination is made as to whether key 45 is pressed, if so the program proceeds to step 174 in which the home team score is displayed in the digits. Thereafter the program returns once again to step 111 and from there returns via step 168 and intermediate steps to step 173. If in step 173 it is determined that key 45 is not pressed, the program proceeds to the final interrogation of the status mode in step 175 in which a determination is made as to whether key 42 is pressed. If key 42 is pressed, the program proceeds to step 176 in which the yardage required for a first down is displayed. Thereafter, the program returns to step 111. If in step 175 it is determined that key 42 is not pressed the program returns directly to step 111. After any or all interrogations have been carried forward, the game may be returned to the play mode by pressing key 40 prior to the program return to step 168. Thereupon, during that pass through step 168 the program proceeds to step 177 and from there to step 102 to initiate a return game play.

As mentioned above, the foregoing flow chart provides a multiplicity of game play possibilities and functions. Also, the program contains numerous branches and equally numerous possibilties of information processing paths. All such paths are clearly shown in FIGS. 3A through 3E. However, the foregoing explanations of game play are intended to facilitate understanding of the operation of the present invention electronic football game and not to represent a complete step-by-step explanation of every possibility within the multiplicity of flow chart branches. Accordingly, resort may be had to FIGS. 3A through 3E for complete specification of all flow chart steps necessary to enable practitioners in the art to implement the present invention electronic football game and to draft appropriate computer programs therefore.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. An electronic football game comprising:

a microprocessor control circuit including both a read only memory and a random access memory for establishing a predetermined set of playing rules;

a plurality of operable instruction keys including a plurality of ball-carrier directional movement keys each corresponding to a ball carrier movement direction coupled to said control circuit;

display means having a stationary offensive player character as viewed from behind, a perspective view of a portion of a football field as would be viewed by an offensive player including a pair of merging sideline markers and, a plurality of illuminatable defensive player characters arranged in a plurality of rows, said illuminatable defensive player characters in each of said rows being progressively smaller and more closely spaced for rows more distant from said stationary offensive player character;

means causing said defensive player characters to be substantially less visible when not illuminated;

motion means for effecting apparent motion of said defensive player characters by sequential illumination of selected ones of said plurality of illuminatable defensive player characters;

means, responsive to a user actuation of a selected one of said ball-carrier directional movement keys, for causing said motion means to give apparent relative motion of said stationary offensive player in the selected movement direction by sequentially illuminating only the selected ones of said illuminatable defensive player characters immediately adjacent those illuminated before key actuation to give the appearance of motion of said defensive player characters in the direction opposite to that of said selected key; and means for establishing a predetermined set of relationships between said stationary offensive player character and said illuminated ones of said illuminatable defensive player characters which constitute a tackle and terminating offensive play when said conditions are met.

2. An electronic football game comprising:

display means for depicting a stationary offensive ball-carrier, and at least a portion of a football field as it would appear to an offensive ball-carrier and including a plurality of defensive player characters;

a control circuit including mode means for operating said control circuit in a run mode, a passing mode, or a kicking mode and means for randomly establishing an illumination pattern of selected ones of said plurality of defensive player characters;

signal means for providing input signals to said control circuit including a plurality of user operable keys corresponding to a plurality of offensive ball carrier movement directions including a forward run key; and stored program means within said control circuit responsive to said signal means for effecting apparent offensive ball-carrier players when one of said keys is operated by causing said display means to shift only said illumination pattern of selected ones of said defensive player characters in the opposite direction to that selected corresponding to the operated one of said keys.

3. An electronic football game as set forth in claim 2 wherein said control circuit includes means for varying said illumination pattern of said plurality of defensive player characters to create openings in the defensive player character pattern and wherein said mode means includes tackle determination means for determining whether said offensive ball-carrier safely passes between illuminated defensive player characters or is tackled thereby.

4. An electronic football game as set forth in claim 3 wherein said plurality of user operable keys includes a pass key and wherein said mode means is responsive to said pass key to configure the play of said electronic football game to said pass mode.

5. An electronic football game as set forth in claim 4 wherein said mode means includes means responsive to said pass key for establishing an interception distance and for randomly establishing a passing distance; and reception determination means for determining whether said passed football exceeds said interception distance without first encountering an illuminated defensive player character.

6. An electronic football game as set forth in claim 5 further including means for causing said illumination pattern of said defensive player characters to move rapidly toward the bottom of said display depicting a zoomed view of pass play ball flight.

7. An electronic football game as set forth in claim 6 wherein said control circuit includes means, responsive to said reception determination means, for returning the play of said electronic football game back to said run mode to simulate a run after reception of a pass receiver.

8. An electronic football game as set forth in claim 7 further including means for causing said illumination pattern of said defensive player characters to move rapidly toward the bottom of said display depicting a zoomed view of the flight of a kicked ball.

9. An electronic football game as set forth in claim 3 wherein said plurality of user operable keys includes a kick key and wherein said mode means is responsive to said kick key to determine whether a selected defensive player in the vertical direction from said ball-carrier is illuminated.

10. An electronic football game as set forth in claim 9 wherein said mode means includes means responsive to said kick key for randomly establishing a kick distance.

11. An electronic football game as set forth in claim 2 wherein said portion of a football field depicted is a perspective view and wherein said defensive player characters are arranged in a plurality of rows and wherein said defensive players in a given row are large and more widely spaced for rows closer to said ball-carrier than for those more distant therefrom.

* * * * *